US012782023B2

(12) United States Patent
Schroeder et al.

(10) Patent No.: US 12,782,023 B2
(45) Date of Patent: Nov. 3, 2026

(54) REFRIGERATOR APPLIANCE SELF-OPTIMIZING CONTROL SCHEME

(71) Applicant: Haier US Appliance Solutions, Inc., Wilmington, DE (US)

(72) Inventors: Michael Goodman Schroeder, Crestwood, KY (US); Brent Alden Junge, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 132 days.

(21) Appl. No.: 18/811,205

(22) Filed: Aug. 21, 2024

(65) Prior Publication Data

US 2026/0055946 A1 Feb. 26, 2026

(51) Int. Cl.
*F25B 49/02* (2006.01)

(52) U.S. Cl.
CPC ..... *F25B 49/022* (2013.01); *F25B 2600/02* (2013.01); *F25B 2700/151* (2013.01); *F25B 2700/2115* (2013.01)

(58) Field of Classification Search
CPC .... F25B 49/02; F25B 49/022; F25B 2500/15; F25B 2600/025; F25D 29/00
See application file for complete search history.

(56) References Cited

U.S. PATENT DOCUMENTS 5,797,729 A 8/1998 Rafuse, Jr. et al.
6,505,476 B1 * 1/2003 Nishida ..... F25B 41/34 62/210
9,328,956 B2 5/2016 Abbasi et al.
2012/0060525 A1 3/2012 Schork et al.
2013/0219931 A1 * 8/2013 Childs ..... F24F 11/83 62/126
2018/0299179 A1 * 10/2018 Barrios ..... F25D 29/005
2023/0105421 A1 * 4/2023 Allard ..... F25D 21/04 62/115

FOREIGN PATENT DOCUMENTS

DE 20 2008 012 411 * 12/2009
JP H04340058 A 11/1992
WO WO2022199845 A1 8/2022

* cited by examiner

*Primary Examiner* — Jonathan Bradford
(74) *Attorney, Agent, or Firm* — Dority & Manning, P.A.

(57) ABSTRACT

A method of operating a refrigerator appliance includes operating a compressor within a sealed cooling system for a first portion of a period of time and deactivating the compressor for a second portion of the period of time. The method also includes measuring a temperature at an evaporator of the sealed system while operating the compressor for the first portion of the period of time. The method further includes determining an actual duty cycle of the compressor based on a ratio of the first portion of the period of time to the period of time. The method also includes determining an optimal duty cycle of the compressor based on the measured temperature at the evaporator and comparing the actual duty cycle of the compressor to the optimal duty cycle. Based on the comparison of the actual duty cycle to the optimal duty cycle, the speed of the compressor is adjusted.

16 Claims, 6 Drawing Sheets

REFRIGERATOR APPLIANCE SELF-OPTIMIZING CONTROL SCHEME

FIELD OF THE INVENTION

The present subject matter relates generally to refrigerator appliances, and more particularly to methods of operating refrigerator appliances.

BACKGROUND OF THE INVENTION

Refrigerator appliances generally include a cabinet that defines chilled chambers for receipt of food items for storage. Insulated, sealing doors are provided for selectively enclosing the chilled food storage chambers.

Refrigerator appliances typically utilize sealed systems for cooling the chilled chambers. A typical sealed system includes at least one evaporator and a fan, and such refrigerator appliances usually include a separate evaporator for each chamber to achieve different temperatures in each of the chilled chambers. Such sealed systems also include a compressor which urges refrigerant through the sealed system, and the compressor may be a variable speed compressor where the operating speed of the compressor influences the rate of cooling provided to each chilled chamber from the respective evaporator.

The compressor of the sealed system is generally more efficient at slower speeds, however, running the compressor too slowly may result in ineffective cooling, e.g., not reaching a desired setpoint temperature in one or both chilled chambers or taking an excessive time to reach the setpoint temperatures. Additionally, installation conditions and usage patterns, e.g., ambient temperatures and door opening frequencies, vary from one unit to another, making it difficult to achieve efficient operation across an entire model or series of refrigerator appliances when relying on generalized predetermined operating parameters for all units. For example, such generalized operating parameters may result in inefficient energy consumption in some cases or ineffective cooling in other cases.

Accordingly, refrigerator appliances and methods of operating such appliances which include adaptive control, e.g., for the compressor, would be desired in the art.

BRIEF DESCRIPTION OF THE INVENTION

Aspects and advantages of the invention will be set forth in part in the following description, or may be obvious from the description, or may be learned through practice of the invention.

In one aspect of the present disclosure, a method of operating a refrigerator appliance is provided. The refrigerator appliance includes a compressor within a sealed system. The method includes operating the compressor within the sealed cooling system of the refrigerator appliance for a first portion of a period of time and measuring a temperature at an evaporator of the sealed system while operating the compressor for the first portion of the period of time. The method also includes deactivating the compressor for a second portion of the period of time. The method further includes determining an actual duty cycle of the compressor based on a ratio of the first portion of the period of time to the period of time. The method also includes determining an optimal duty cycle of the compressor based on the measured temperature at the evaporator and comparing the actual duty cycle of the compressor to the optimal duty cycle. Based on the comparison of the actual duty cycle to the optimal duty cycle, the speed of the compressor is adjusted.

In another aspect of the present disclosure, a refrigerator appliance is provided. The refrigerator appliance includes a compressor within a sealed cooling system and a controller. The controller is configured for operating the compressor for a first portion of a period of time and measuring a temperature at an evaporator of the sealed system while operating the compressor for the first portion of the period of time. The controller is further configured for deactivating the compressor for a second portion of the period of time. The controller is also configured for determining an actual duty cycle of the compressor based on a ratio of the first portion of the period of time to the period of time and determining an optimal duty cycle of the compressor based on the measured temperature at the evaporator. The controller is further configured for comparing the determined duty cycle of the compressor to a predefined duty cycle. Based on the comparison of the actual duty cycle to the optimal duty cycle, the controller adjusts the speed of the compressor.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
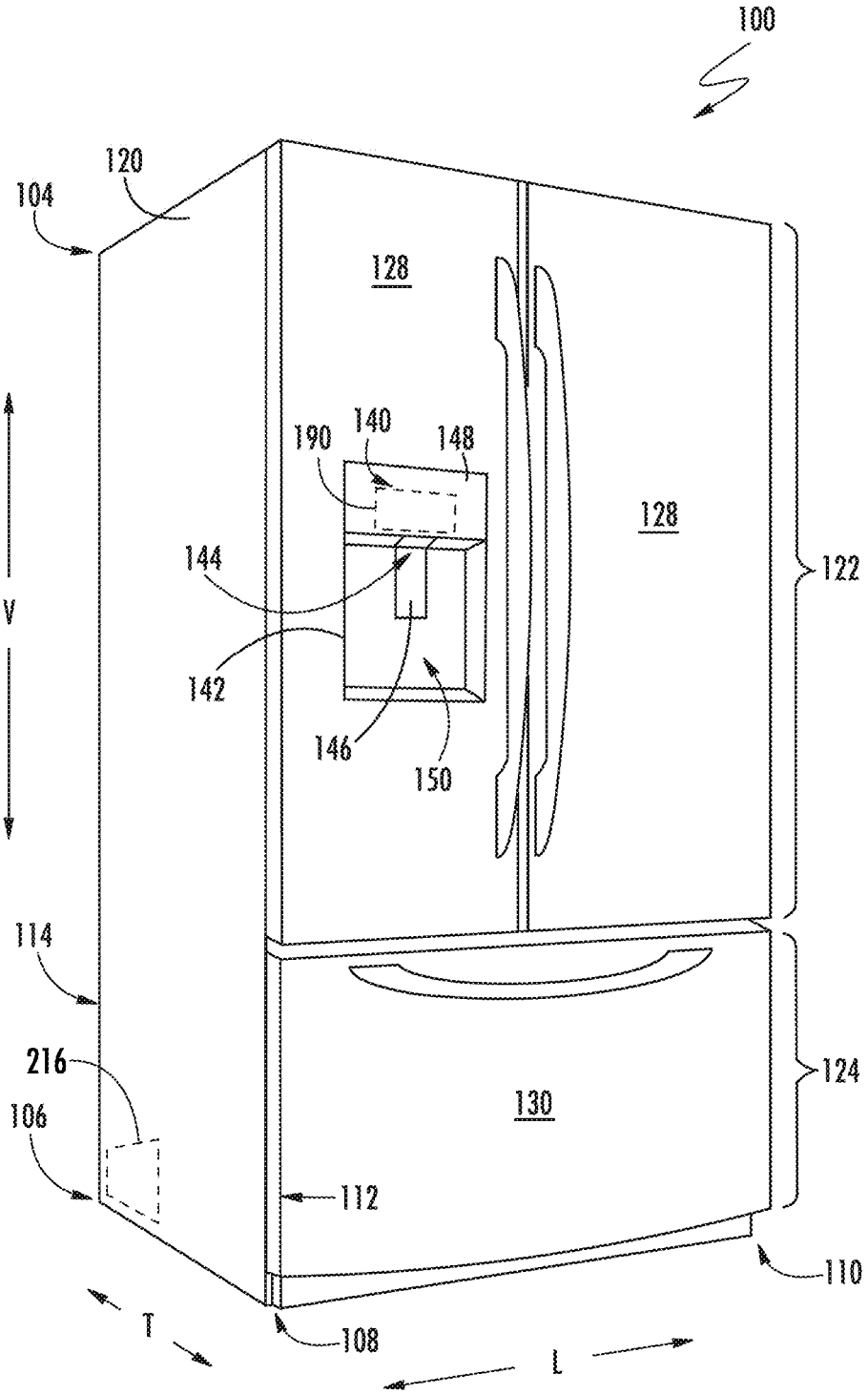
FIG. 1 provides a perspective view of a refrigerator appliance according to one or more example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
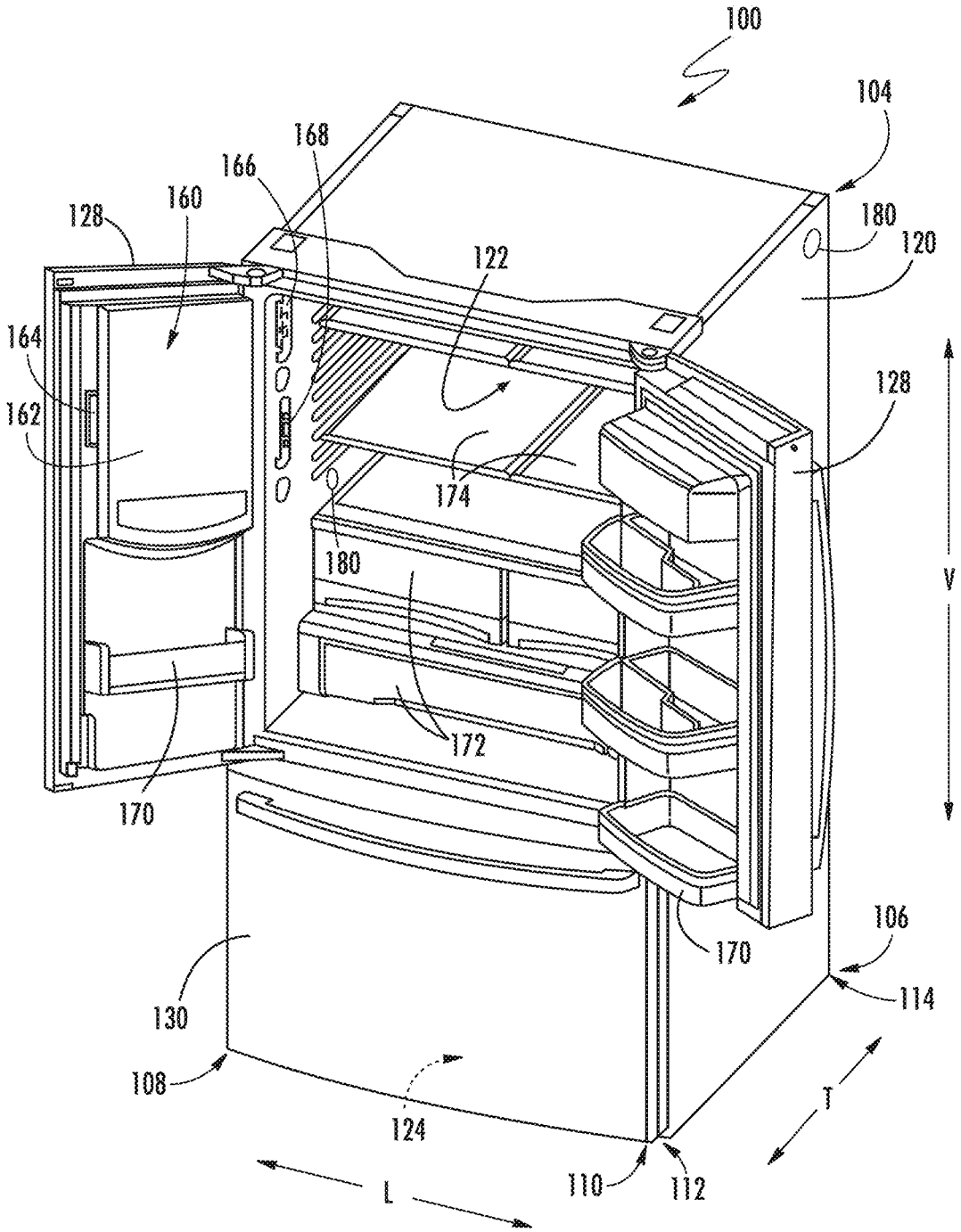
FIG. 2 provides a perspective view of the example refrigerator appliance shown in FIG. 1, wherein refrigerator doors are in an open position according to one or more example embodiments of the present disclosure.

Turning now to the figures, FIG. 1 provides a perspective view of a refrigerator appliance 100 according to an example embodiment of the present disclosure. FIG. 2 provides another perspective view of refrigerator appliance when one or more doors 128, 130 are open. Refrigerator appliance 100 includes a cabinet or housing 120 that extends between a top portion 104 and a bottom portion 106 along a vertical direction V, between a left side 108 and a right side 110 along a lateral direction L, and between a front side 112 and a rear side 114 along a transverse direction T. Each of the vertical direction V, lateral direction L, and transverse direction T are mutually perpendicular to one another and form an orthogonal direction system.

Housing 120 defines chilled chambers for receipt of food items for storage. In particular, housing 120 defines fresh food chamber 122 positioned at or adjacent top portion 104 of housing 120. Refrigerator appliance 100 also includes a freezer chamber 124 that is, for example, arranged at or adjacent bottom portion 106 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance.

Consequently, the description set forth herein is for illustrative purposes only and is not intended to be limiting in any aspect to any particular chilled chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in a closed configuration in FIG. 1. As may be seen when refrigerator doors 128 are in the open configuration, e.g., as illustrated in FIG. 2, various storage components may be provided within one or both of the refrigerated chambers 122 and 124, such as bins 170, drawers 172, and/or shelves 174, in various combinations.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 128. Dispenser 142 includes a discharging outlet 144 for accessing ice and liquid water. An actuating mechanism 146, shown as a paddle, is mounted below discharging outlet 144 for operating dispenser 142. In alternative example embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In example embodiments, dispenser recess 150 is positioned at a level that approximates the chest level of a user.

As shown, for instance in FIG. 2, at least one door 128 may include a door liner defining a sub-compartment, e.g., icebox compartment 160. Icebox compartment 160 extends into fresh food chamber 122 when refrigerator door 128 is in the closed position. Although icebox compartment 160 is shown in door 128, additional or alterative embodiments may include an icebox compartment defined within door 130. An ice making assembly or icemaker (not pictured) may be positioned or disposed within icebox compartment 160. Thus, ice may be supplied to dispenser recess 150 (see FIG. 1) from the icemaker and/or ice dispenser unit in icebox compartment 160 on a back side of refrigerator door 128.

An access door, e.g., icebox door 162, may be hinged to icebox compartment 160 to selectively cover or permit access to opening of icebox compartment 160. Icebox door 162 permits selective access to icebox compartment 160. Any manner of suitable latch 164 is provided with icebox compartment 160 to maintain icebox door 162 in a closed position. As an example, latch 164 may be actuated by a consumer in order to open icebox door 162 for providing access into icebox compartment 160. Icebox door 162 can also assist with insulating icebox compartment 160, e.g., by thermally isolating or insulating icebox compartment 160 from fresh food chamber 122. This thermal insulation helps maintain icebox compartment 160 at a temperature below the freezing point of water. In addition icebox compartment 160 may receive cooling air from a chilled air supply duct 166 and a chilled air return duct 168 disposed on a side portion of housing 120 of refrigerator appliance 100. In this manner, the supply duct 166 and return duct 168 may recirculate chilled air from a suitable sealed cooling system 200 (see FIG. 3) through icebox compartment 160.

Operation of the refrigerator appliance 100 can be generally controlled or regulated by a controller 190. Controller 190 may control or regulate various portions of refrigerator appliance 100 according to one or more discrete criteria. In other words, controller 190 may be configured to control refrigerator appliance 100, for example, according to one or more exemplary methods described herein and/or may be configured to perform some or all of such exemplary methods.

In some embodiments, controller 190 is operatively coupled to user interface panel 148 and/or various other components, as will be described below.

User interface panel 148 provides selections for user manipulation of the operation of refrigerator appliance 100. As an example, user interface panel 148 may provide for selections between whole or crushed ice, chilled water, and/or specific modes of operation. In response to one or more input signals (e.g., from user manipulation of user interface panel 148 and/or one or more received sensor signals), controller 190 may operate various components of the refrigerator appliance 100 according to the current mode of operation.

Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes programming instructions stored in memory. For certain embodiments, the instructions include a software package configured to operate appliance 100 and, e.g., execute an operation routine including one or more example methods described below. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 190, or portions thereof, may be positioned in a variety of locations throughout refrigerator appliance 100. In example embodiments, controller 190 is located within the user interface panel 148. In other embodiments, the controller 190 may be positioned at any suitable location within refrigerator appliance 100, such as for example within a fresh food chamber, a freezer door, etc. In additional or alternative embodiments, controller 190 is formed from multiple controllers or controller components mounted at discrete locations within or on refrigerator appliance 100. Input/output ("I/O") signals may be routed between controller 190 and various operational components of refrigerator appliance 100. For example, user interface panel 148 may be operatively coupled to controller 190 via one or more signal lines or shared communication busses.

In some embodiments, one or more temperature sensors 180 and 216 are included with refrigerator appliance 100. As an example, a first temperature sensor 180 may be in operable communication with the fresh food chamber 122 and a second temperature sensor 216 may be in operable communication with the freezer chamber 124 of the refrigerator appliance 100. Such temperature sensors 180 and 216 may, for example, be mounted to a liner within cabinet 120. During operations, temperature sensors 180 and 216 may thus detect the temperature within the respective refrigerated chambers 122 and 124.

Temperature sensors 180 and 216 may be any suitable temperature sensor operatively coupled to controller 190. For example, one or both of temperature sensors 180 and 216 may be a thermistor, a thermocouple, a resistance thermometer, etc. During certain operations, measurements from temperature sensors 180 and 216 may be utilized to initiate and/or terminate one or more cycles of sealed cooling system 200, e.g., when a setpoint temperature is reached in one of the refrigerated chambers 122 or 124.

In some embodiments, controller 190 is operatively coupled to the various components of dispensing assembly 140 and may control operation of the various components. For example, the various valves, switches, etc. may be actuatable based on commands from the controller 190. As discussed, interface panel 148 may additionally be operatively coupled to the controller 190. Thus, the various operations may occur based on user input or automatically through controller 190 instruction.

Figure 3:
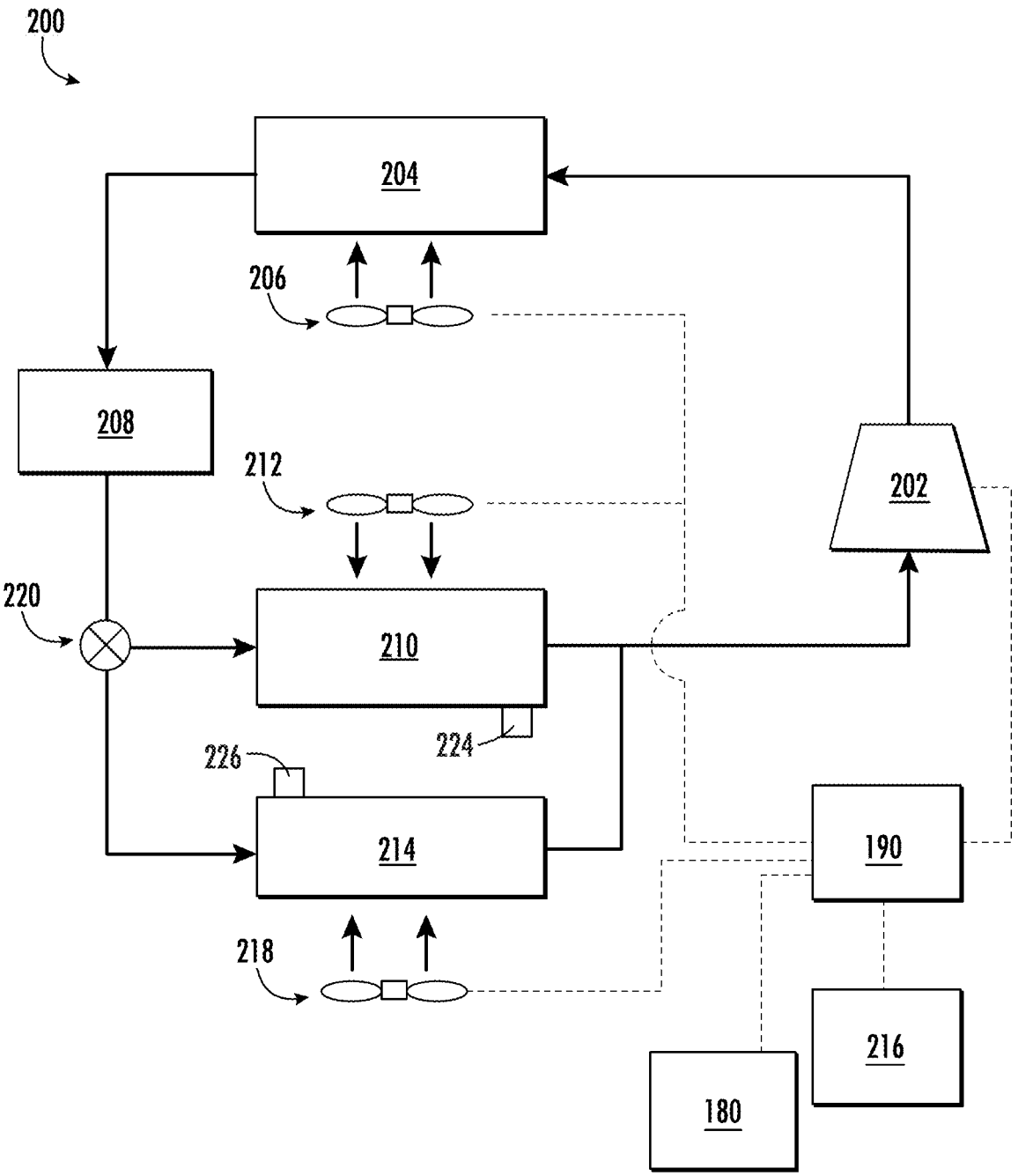
FIG. 3 provides a schematic view of various components of the example embodiments of FIG. 1.

Referring now to FIG. 3, refrigerator appliance 100 may include a sealed refrigeration or cooling system 200. In general, sealed cooling system 200 is charged with a refrigerant that is flowed through various components and facilitates cooling of the fresh food compartment 122 and the freezer compartment 124. Sealed cooling system 200 may be charged or filled with any suitable refrigerant, such as R441A, R600a, R600, R290, etc.

Sealed cooling system 200 includes a compressor 202 for compressing the refrigerant, thus raising the temperature and pressure of the refrigerant. Compressor 202 may for example be a variable speed compressor 202, such that the speed of the compressor 202 can be varied between zero (0%) and one hundred percent (100%) by controller 190. Sealed cooling system 200 may further include a condenser 204, which may be disposed downstream of compressor 202, e.g., in the direction of flow of the refrigerant. Thus, condenser 204 may receive refrigerant from the compressor 202, and may condense the refrigerant by lowering the temperature of the refrigerant flowing therethrough due to, e.g., heat exchange with ambient air. A condenser fan 206 may be used to force air over condenser 204 as illustrated to facilitate heat exchange between the refrigerant and the surrounding air. Condenser fan 206 can be a variable speed fan—meaning the speed of condenser fan 206 may be controlled or set anywhere between and including, e.g., zero (0%) and one hundred percent (100%). The speed of condenser fan 206 can be determined, and communicated to fan 206, by controller 190.

Sealed cooling system 200 further includes evaporators 210 and 214, e.g., a dedicated evaporator for each of the fresh food chamber 122 the freezer chamber 124, disposed downstream of the condenser 204. Additionally, an expansion device 208 (e.g., a capillary tube, electronic expansion valve, or other similar device) may be utilized to expand the refrigerant, and thus further reduce the pressure of the refrigerant, leaving condenser 204 before being flowed to evaporators 210 and 214.

A valve 220 may be provided between the expansion device 208 and the evaporators 210 and 214, e.g., the valve 220 may be upstream of the evaporators 210 and 214 and may be configured to selectively direct refrigerant flow from the expansion device 208 to one or the other of the evaporators 210 and 214. In additional exemplary embodiments, multiple expansion devices 208 may be provided, e.g., at least one expansion device 208 for each evaporator 210 and 214, and the valve 220 may be immediately downstream of the condenser 204 and upstream of the expansion devices 208 to selectively direct refrigerant flow to one or the other of the evaporators 210 and 214 through the respective expansion devices 208. Each evaporator 210 and 214 generally is a heat exchanger that transfers heat from air passing over the evaporator 210, 214 to refrigerant flowing through evaporator 210, 214, thereby cooling the air and causing the refrigerant to vaporize. A first evaporator fan 212 may be used to force air over first evaporator 210 and a second evaporator fan 218 may be used to force air over second evaporator 214 as illustrated. As such, cooled air is produced and supplied to refrigerated compartments 122, 124 of refrigerator appliance 100. In certain embodiments, the evaporator fans 212 and 218 may each be a variable speed evaporator fan—meaning the speed of each fan 212, 218 may be controlled or set anywhere between and including, e.g., zero (0%) and one hundred percent (100%).

The speed of each evaporator fan 212 and 218 may be determined by controller 190, and communicated to each evaporator fan 212, 218 by controller 190.

First evaporator 210 may be in communication with fresh food compartment 122 and second evaporator 214 may be in communication with freezer compartment 124 to provide cooled air to compartments 122, 124. In other embodiments, each evaporator 210, 214 may be in communication with any suitable component of the refrigerator appliance 100. For example, in some embodiments, evaporator 210 or 214 may be in communication with the ice maker, such as with an ice compartment 160 (FIG. 2). From the selected evaporator 210 or 214 (e.g., which is selected by the valve 220 or is selected based on the position of the valve 220), refrigerant may flow back to and through compressor 202, which may be downstream of the selected evaporator 210 or 214, thus completing a closed refrigeration loop or cycle.

Also as may be seen in FIG. 3, refrigerator appliance 100 may further include one or more temperature sensors positioned and configured to measure a temperature at an evaporator of the sealed system. For example, refrigerator appliance 100 may include temperature sensors 224 and 226, each of which is positioned at a respective one of the evaporators 210 and 214. Each temperature sensor 224, 226 may be in communication with the controller 190, e.g., to transmit a signal to the controller 190 which represents or is proportional to the temperature at the corresponding evaporator 210, 214. Each temperature sensor 224, 226 may be positioned at the respective evaporator 210, 214, e.g., each temperature sensor 224, 226 may be in direct contact with the respective evaporator 210, 214 or may be positioned sufficiently proximate to the respective evaporator 210, 214 that the temperature sensor 224, 226 may be in thermal communication with the respective evaporator 210, 214 to measure the temperature of the respective evaporator 210, 214 with an accuracy of plus or minus two degrees Fahrenheit or less, such as plus or minus one degree Fahrenheit.

Figure 4:
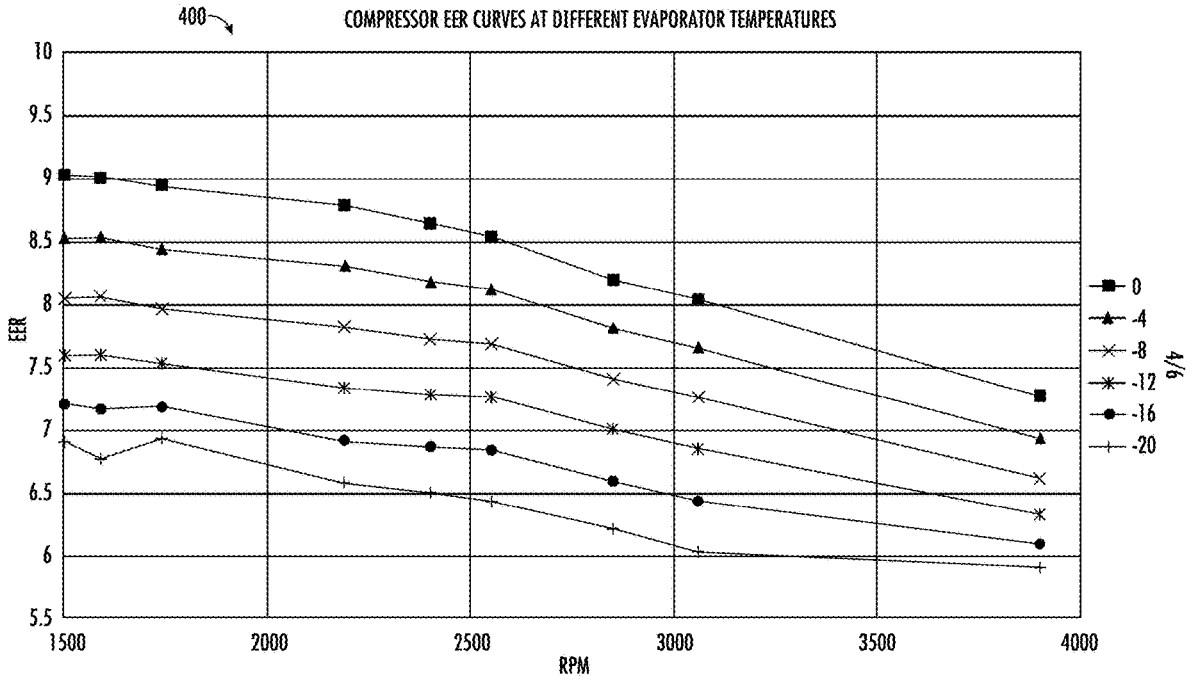
FIG. 4 provides a graph of exemplary efficiency curves for a compressor of a refrigerator appliance in accordance with one or more example embodiments of the present disclosure.

FIG. 4 provides an exemplary graph 400 of compressor EER (Energy Efficiency Ratio) curves at different evaporator temperatures. The noted temperatures are temperatures at the evaporators, e.g., which are generally cooler than the resultant temperature in the chilled chamber(s) downstream of the evaporators, and which may be measured by temperature sensors 224 and/or 226, e.g., as opposed to temperature sensors 180 and 216 which measure chamber temperatures. As illustrated in FIG. 4, the horizontal axis provides exemplary compressor speeds, increasing from left to right, in Revolution Per Minute (RPM), and the vertical axis provides exemplary EER values, with efficiency increasing from the origin to the top of the graph on the page in FIG. 4.

Additionally, six exemplary EER curves for possible example evaporator temperatures are plotted in FIG. 4. As may be seen from FIG. 4, the compressor is generally more efficient at higher temperatures and slower speeds. Also as may be seen from FIG. 4, the slopes of the EER curves vary within each curve and from one curve to the next, e.g., such that changing compressor speeds within a same range of speeds may have differing effects on the achieved efficiency at different evaporator temperatures, and/or changing compressor speeds at a constant evaporator temperature (e.g., along a single EER curve in FIG. 4) may have differing effects on the achieved efficiency at different compressor speed ranges.

For one particular example that may be seen in FIG. 4, at an evaporator temperature of negative eight degrees (−8), decreasing the compressor speed from 4000 RPM to 3000 RPM provides a larger increase in efficiency than would decreasing the compressor speed from 2500 RPM to 1500 RPM, e.g., the same net change in speed (decrease by 1000 RPM) provides a greater efficiency benefit at some speed ranges than others.

As another example that may be seen in FIG. 4, decreasing compressor speed from 2500 RPM to 2000 RPM at an evaporator temperature of zero (0) degrees provides a larger increase in efficiency than decreasing compressor speed from 2500 RPM to 2000 RPM at an evaporator temperature of negative twelve (−12) degrees, e.g., the same speed change provides a greater efficiency benefit at some evaporator temperatures than others. It should be understood that the values noted herein and in FIGS. 4 and 5 are provided by way of example only for purposes of illustrating one or more possible embodiments out of numerous possible variations in temperature, speed, and/or efficiency.

Figure 5:
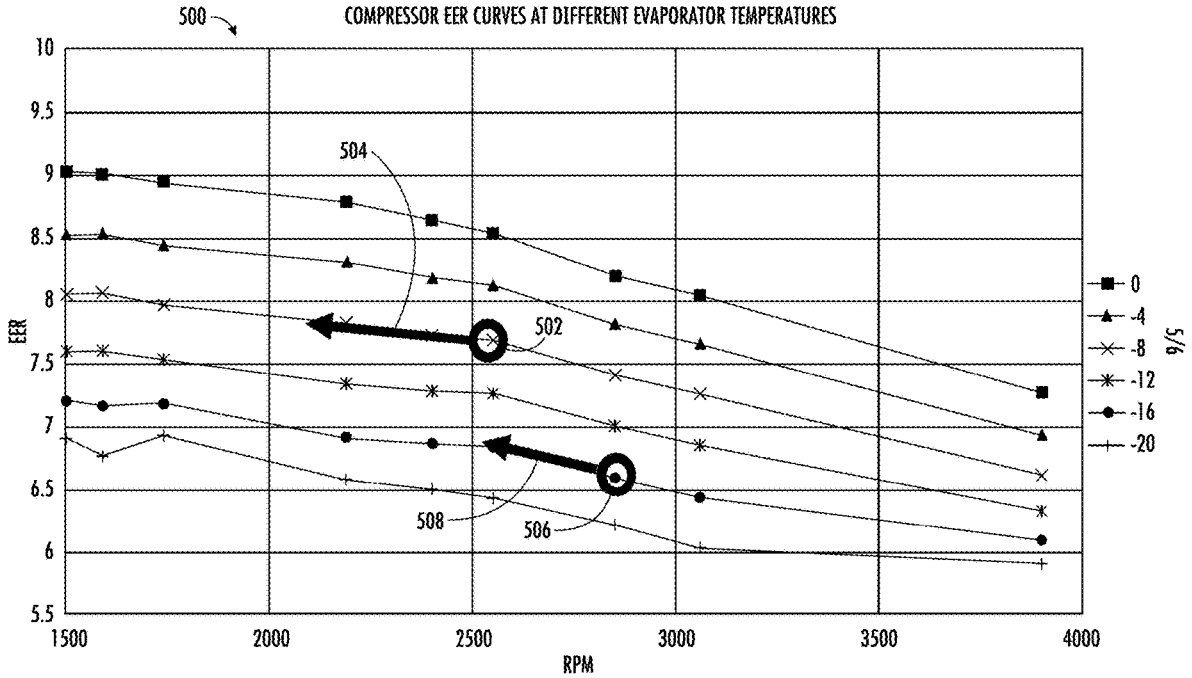
FIG. 5 illustrates current operating points for evaporators of a refrigerator appliance and potential compressor speed adjustments along respective efficiency curves in accordance with example embodiments of the present disclosure.

FIG. 5 provides a graph of EER curves, e.g., which may be the same EER curves described above with reference to FIG. 4, and exemplary operating points for two evaporators, e.g., a fresh food evaporator and a freezer evaporator, in a refrigerator appliance. For example, as illustrated in FIG. 5, one of the evaporators, e.g., a first evaporator or fresh food evaporator, may be operable at an evaporator temperature of negative eight (−8) degrees. In an exemplary operation, the operating point 502 for fresh food mode (e.g., when valve 220 (FIG. 3) directs refrigerant to the fresh food evaporator) may thus correspond to a compressor speed of about 2500 RPM for one or more operation cycles (e.g., duty cycles), while the operating point 506 for freezer mode (e.g., when valve 220 (FIG. 3) directs refrigerant to the freezer evaporator, which in the illustrated example is operable at an evaporator temperature of negative sixteen (−16) degrees) may thus correspond to a compressor speed of about 2800 RPM during a freezer portion of the same cycle(s). Also illustrated by way of example in FIG. 5 are potential compressor speed adjustments 504 and 508 (which are speed decreases in this example, although speed increases are also possible as well as or instead of decreases) which may be determined, and/or of which one or other may be selected for implementation. For example, when a decrease in compressor speed (and a corresponding increase in duty cycle of the compressor, as will be discussed further below) is called for, the curve with the greatest slope to the left of the current operating point may be selected in order to provide the greatest efficiency benefit for the given speed decrease, or the least efficiency penalty in cases of a speed increase (which would correspond to the shallower slope to the right of the current operating point). Turning to the specific example first operating point 502, first compressor speed adjustment 504, second operating point 506, and second compressor speed adjustment 508, illustrated in FIG. 5, it may be seen that the slope to the left of operating point 506 is greater than the slope to the left of operating point 502. Thus, decreasing the compressor speed during operation of the second evaporator, e.g., during freezer mode, provides a greater efficiency benefit than a similar decrease in compressor speed during operation of the first evaporator, e.g., fresh food mode. Accordingly, the compressor speed adjustment 508 may be prioritized over adjustment 504, e.g., adjustment 508 may be implemented rather than adjustment 504, or both speeds may be adjusted based on a ratio of the slopes where a larger adjustment would be applied to the second operating point 506, in order to maximize the increase in efficiency from the speed decrease.

Figure 6:
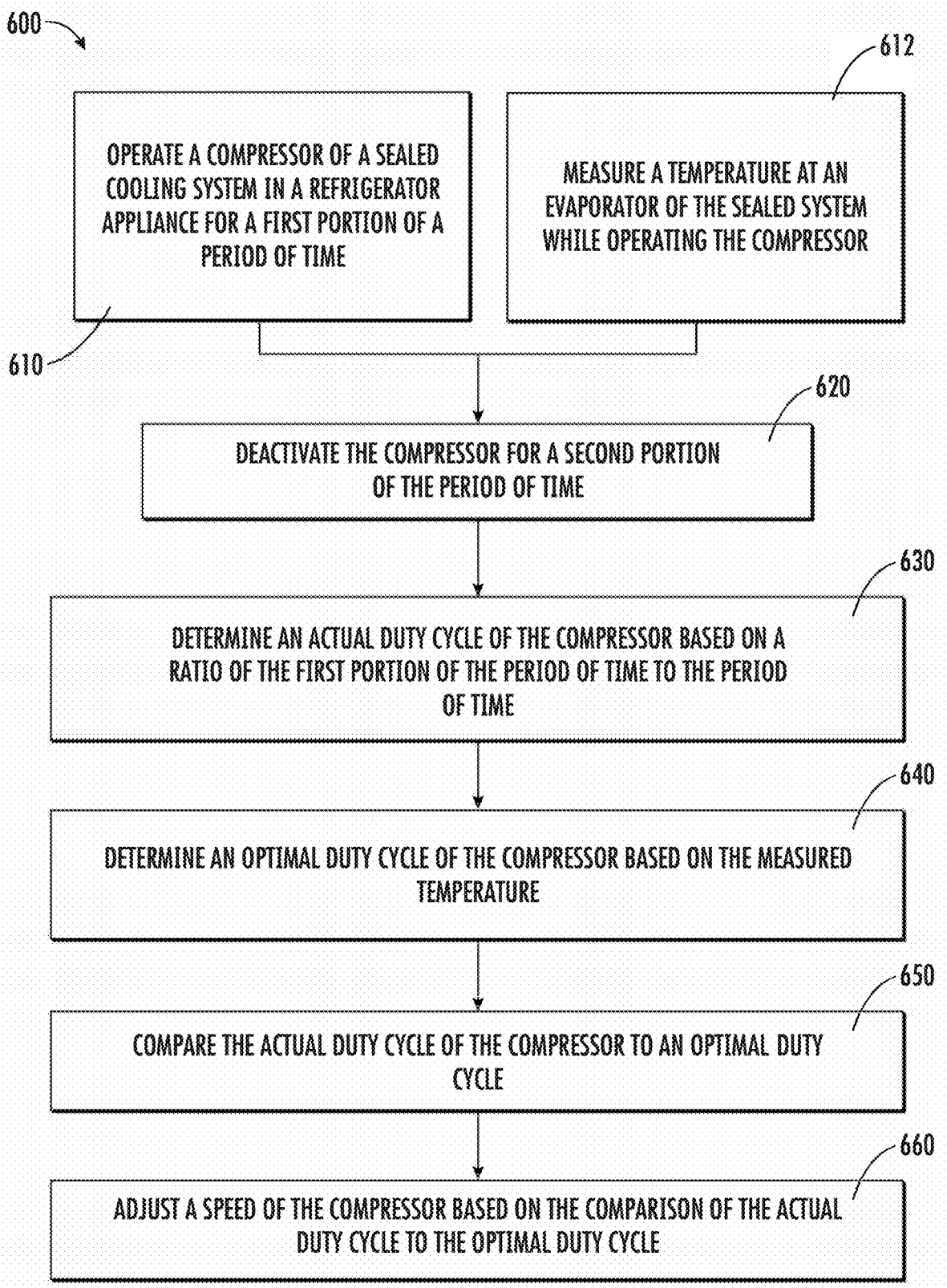
FIG. 6 provides a flow chart illustrating a method of operating a refrigerator appliance in accordance with example embodiments of the present disclosure.

Turning now to FIG. 6, embodiments of the present disclosure may also include methods of operating a refrigerator appliance, such as the exemplary method 600 illustrated in FIG. 6. Such methods may be used with any suitable refrigerator appliance, for example but not limited to the exemplary refrigerator appliance 100 described above. Thus, the refrigerator appliance operated according to method 600 may include a compressor within a sealed cooling system, e.g., compressor 202 within sealed cooling system 200, as described above in reference to FIG. 3, and the compressor may be a variable speed compressor where the efficiency of the compressor varies with speed of the compressor and with the temperature of one or more evaporators coupled with the sealed cooling system, e.g., as described above in reference to FIGS. 4 and 5.

As illustrated in FIG. 6, in some embodiments, methods according to the present disclosure such as method 600 may include (610) operating the compressor for a first portion of a period of time. For example, operating the compressor for the first portion of the period of time may include operating the compressor in one or both of a fresh food mode and/or a freezer mode. In such embodiments, the first portion of the period of time may be the amount of time it takes to cool one or more chilled chambers of the refrigerator appliance, e.g., one or both of the fresh food chamber 122 and the freezer chamber 124, to a setpoint temperature (or within a threshold of the setpoint temperature). The setpoint temperature may be a default predetermined value, e.g., that is preprogrammed into a memory of a controller such as the controller 190, or may be a user-selected value which is received via one or more user inputs of the refrigerator appliance. The setpoint temperature (and/or other ending temperature, such as within the threshold of the setpoint temperature) may be measured and/or detected by a temperature sensor in operative communication with the respective chilled chamber, e.g., temperature sensor 180 for fresh food chamber 122 or temperature sensor 216 for freezer chamber 124.

Method 600 may also include (612) measuring a temperature at an evaporator of the sealed system while operating the compressor for the first portion of the period of time. For example, where operating the compressor for the first portion of the period of time includes operating the compressor both of fresh food mode and freezer mode, the first portion of the period of time includes a fresh food cooling time and a freezer cooling time, and measuring the temperature at the evaporator of the sealed system while operating the compressor for the first portion of the period of time may include measuring a temperature at a fresh food evaporator during the fresh food cooling time (e.g., measuring a temperature of evaporator 210 with temperature sensor 224) and measuring a temperature at a freezer evaporator during the freezer cooling time (e.g., measuring a temperature of evaporator 214 with temperature sensor 226).

Still referring to FIG. 6, method 600 may further include (620) deactivating the compressor for a second portion of the period of time. For example, once the setpoint temperature in the chilled chamber (or each respective setpoint temperature for multiple chilled chambers in some embodiments) is reached, the compressor may be turned off for a period of time, e.g., until the temperature within the chilled chamber (or each chilled chamber) reaches an upper limit and further cooling is called for. In one exemplary operating cycle, e.g., where the refrigerator appliance includes at least two chilled chambers, e.g., at least the fresh food chamber 122 and the freezer chamber 124, and one corresponding evaporator for each chilled chamber, the total period of time may include a fresh food cooling time, a freezer cooling time, and one or more down times during which the compressor is deactivated. For example, the cycle may include a fresh food cooling time, followed by a first down time, then a freezer cooling time and a second down time after the freezer cooling time. The cycle may then repeat after the second down time, e.g., may reiterate beginning with a next fresh food cooling time of a next operating cycle. In some embodiments, only one down time may be provided, e.g., either after the fresh food cooling time and before the freezer cooling time or after the freezer cooling time and before the fresh food cooling time of the next cycle, or no down time may be provided, e.g., the duty cycle of the compressor may be one hundred percent (100%).

As noted at (630) in FIG. 6, method 600 may further include determining an actual duty cycle of the compressor based on a ratio of the first portion of the period of time to the period of time. For example, the first portion of the period of time may be a single amount of time over which the compressor is continuously activated, or may be a total of multiple amounts of time over which the compressor is activated, e.g., a sum of a fresh food cooling time and a freezer cooling time. The first portion and the second portion may add up to the total period of time. The total period of time may be the period of the duty cycle. For example, the period may be one hour, and the operating cycle may include fifteen minutes in fresh food mode (e.g., a fifteen-minute fresh food cooling time) and thirty minutes in freezer mode (e.g., a thirty-minute freezer cooling time), for a total first portion of the period of time of forty five minutes. Thus, the second portion of the period of time would be fifteen minutes, and the duty cycle, e.g., the ratio of the first portion of the period of time to the period of time, would be forty five minutes out of the sixty minute period—seventy five percent (75%). The foregoing values are provided by way of example only and without any limitation of the present disclosure, e.g., the period may be any suitable value in minutes and/or hours, and the duty cycle may vary as well.

Method 600 may further include (640) determining an optimal duty cycle of the compressor based on the measured temperature at the evaporator. For example, the measured temperature at the evaporator may be used to select an EER curve or curves (such as one or more of the exemplary EER curves described above with respect to FIGS. 4 and 5) and the optimal duty cycle may be determined with reference to the selected EER curve(s) that correspond to the measured temperature (or temperatures, e.g., when there are two or more evaporators).

Method 600 may also include (650) comparing the actual duty cycle of the compressor to the optimal or optimized duty cycle, which may also be referred to as a target duty cycle. The optimal duty cycle may be a duty cycle value which provides the desired cooling level, e.g., cools the one or more chilled chambers to the setpoint temperature within the total period of time, while also providing energy efficiency, e.g., by operating the compressor at a relatively low speed, e.g., at or about a lowest possible speed to complete the desired cooling within the total time period of the duty cycle. Thus, the optimal duty cycle may be between about eighty percent (80%) and about one hundred percent (100%), but not greater than 100% (it being understood that the compressor cannot be activated more than 100% of the time). For example, the optimal duty cycle may be between about ninety percent (90%) and about one hundred percent (100%), such as the optimal duty cycle may be about ninety five percent (95%). In some embodiments, the optimal duty cycle may be a range, such as a range from 95% to 100%, or other ranges of values described herein as opposed to a single target value.

In some embodiments, method 600 may also include (660), adjusting a speed of the compressor based on the comparison of the actual duty cycle to the optimal duty cycle. For example, when the actual duty cycle is less than the optimal duty cycle, the compressor speed may be reduced such that the cooling operation takes longer to reach the setpoint temperature, thereby lengthening the first portion of the period of time and increasing the duty cycle. As another example, when the actual duty cycle is greater than the optimal duty cycle, the compressor speed may be increased such that the cooling operation reaches the setpoint temperature more quickly, thereby shortening the first period of time and reducing the first the duty cycle. Adjusting the speed of the compressor may include setting a single target speed for the compressor or may include defining a range of speeds for the compressor, such as updating low and high compressor speed parameters (and/or additional speed parameters, such as a medium speed) to seek or maintain optimum energy consumption.

In some embodiments, the first portion of the period of time may include a fresh food cooling time and a freezer cooling time, which may occur one directly after another or which may be separated by at least part of the second portion of the period of time, e.g., a down time. In such embodiments, the compressor may be operated at a fresh food cooling speed during the fresh food cooling time and may be operated at a freezer cooling speed during the freezer cooling time, and such speeds may be the same speed or different speeds. In such embodiments, the adjusted speed of the compressor, e.g., which is adjusted at (660) as described above, may be at least one of the fresh food cooling speed and the freezer cooling speed.

For example, in embodiments where one of the fresh food cooling speed and the freezer cooling speed is adjusted, or when both are adjusted by varying degrees, exemplary methods may include determining which of the fresh food cooling speed and the freezer cooling speed to adjust, or the proportions by which each is adjusted, based on an efficiency of the compressor.

In some embodiments, the efficiency of the compressor may be determined from an EER, such as the exemplary EER curves described above in reference to FIGS. 4 and 5, and the EER curve may be selected based on the measured temperature during the operation of the compressor, such that the determined optimal duty cycle more accurately represents the operating conditions experienced by the compressor and/or the optimal duty can adapt or self-adjust in response to changes in such operating conditions from one cycle to another. For example, the efficiency and/or capacity of the sealed system, and of the compressor in particular, may change over time, e.g., the actual temperature achieved at an evaporator (and measured while operating the compressor) may vary from the expected or designed temperature.

Thus, by measuring the temperature at the evaporator while operating the compressor and basing an optimal duty cycle on such measured temperature, methods according to the present disclosure may adapt to variations in, e.g., installation conditions, usage patterns, capacity and/or efficiency of the compressor, and other such variations over the life of the sealed system.

The data represented by the EER curves, such as the exemplary EER curves described above in reference to FIGS. 4 and 5, may be stored in a memory of a controller of the refrigerator appliances, such as in a grid or tabular form. For example, the data in the fields of the table may represent points along each EER curve, and such data may be used to calculate slopes of each EER curve. The slope of the EER curve or curves (e.g., calculated from tabular data as noted) may be used to determine which speed, e.g., during which operating mode, to adjust (or the proportion of adjustment applied to two or more adjusted speeds).

In additional embodiments, the efficiency of the compressor may also or instead be determined using a model which incorporates one or more temperature data and/or other operating parameter data such as compressor speed as well as or instead of the compressor curves (e.g., EER curves of the compressor). For example, the efficiency of the compressor may be determined (at least in part) using a heat exchanger model that incorporates data such as one or both evaporator temperatures, condenser temperature, and/or air temperature in one or both compartments. As another example, the efficiency of the compressor may be determined using a sealed system model which may incorporate the heat exchanger model or one or more data therefrom, as well as compressor data such as compressor speed and/or EER. In such examples, the model (e.g., heat exchanger model and/or sealed system model) may output operating points, such as compressor speed(s) and/or corresponding duty cycles, such as the optimal duty cycle.

In additional embodiments, the efficiency of the compressor may be determined from data collected in the field, e.g., by the particular refrigerator appliance unit during one or more operation cycles of the compressor therein. For example, one or more power meters, e.g., current sensor, wattage sensor, etc., may be provided in the refrigerator appliance and may be in communication with the controller of the refrigerator appliance to provide power consumption measurements to the controller. Thus, the power usage by the compressor during prior operations may be used to develop one or more bespoke EER curves for the particular refrigerator appliance unit, which may most accurately reflect the specific installation conditions and usage patterns of that particular refrigerator appliance unit.

Accordingly, methods of operating the refrigerator appliance which include determining which of the fresh food cooling speed and the freezer cooling speed to adjust based on an efficiency of the compressor may also include measuring power consumption during operation of the compressor and determining the efficiency of the compressor based on the measured power consumption.

As mentioned above, in some embodiments, the first portion of time may include a fresh food cooling time and a freezer cooling time. In such embodiments, adjusting the speed of the compressor may include adjusting the speed of the compressor at the end of one of the fresh food cooling time and the freezer cooling time. For example, adjustments to the compressor speed may be determined and/or applied when a valve (e.g., valve 220 described above in reference to FIG. 3) changes position, e.g., when the cooling of the fresh food chamber or freezer chamber has just finished and the valve changes position to direct refrigerant to the other evaporator.

In some embodiments the first portion of the period of time may include a fresh food cooling time and a freezer cooling time, e.g., where the compressor may be operated at a fresh food cooling speed during the fresh food cooling time and may be operated at a freezer cooling speed during the freezer cooling time. In such embodiments, adjusting the speed of the compressor may include adjusting both the fresh food cooling speed and the freezer cooling speed, whereby an average power draw of the compressor is minimized. For example, the total duty cycle, e.g., the total time in which the compressor is activated during the period of the duty cycle, may be unevenly divided between the fresh food mode and the freezer mode, such as the freezer mode may be longer, such as the freezer mode may be approximately one and a half times as long, or approximately twice as long, etc., as the fresh food mode. For example, the fresh food mode may be about 30% of the total period and the freezer mode may be about 65% of the total period, for a net duty cycle of about 95%. In embodiments where the fresh food time is not equal to the freezer time, a duty cycle ratio may be determined, e.g., about 1.5:1 or about 2:1 freezer to fresh food, as discussed. Similarly, a slope ratio may be determined based on the ratio of the slopes next to each operating point. Accordingly, some embodiments may include multiplying the slope ratio by the duty cycle ratio, in order to make the adjustment logic directly minimize average power draw of the compressor.

In embodiments where more than one compressor speed is adjusted, e.g., where the fresh food speed and the freezer speed are both adjusted, the speeds may be adjusted in the same direction, e.g., both (or all, if more than two) increased or both/all decreased. In additional embodiments, the speeds may be adjusted in opposite directions, such as when the relative slopes suggest or indicate a more efficient operating point exists. For example, if the slope to the left of a first operating point is much greater than the slope to the right of a second operating point, the compressor speed at the first operating point may be decreased while the compressor speed at the second operating point is increased, where the efficiency penalty from increasing the speed at the second operating point is relatively small (e.g., as indicated by the slope to the right of the operating point) and is therefore offset by the relatively large efficiency gain from decreasing the compressor speed at the first operating point (e.g., as indicated by the slope to the left of the first operating point).

Aspects of the present disclosure relate to an adaptive control scheme that actively targets and seeks a given total duty cycle, such as a range from 95-100%, while balancing the FF and FZ compressor speeds to minimize energy consumption dynamically using compressor efficiency data, such as EER/Speed curve slopes and/or empirical data gathered from one or more power meters during prior operating cycles of the specific refrigerator unit. The duty cycle may be divided into both fresh food (FF) and freezer (FZ) duty cycles, which run semi-independently (e.g., the duty cycles may be 65% FZ+30% FF=95% total). Adjustments may occur when the valve changes position, having just finished cooling the FF or FZ. Additionally, adjustments may occur when "timeout" event take place or when the opposite compartment reaches an excessively high temperature before cooling is completed in the current compartment. In such cases, e.g., when the opposite compartment reaches an excessively high temperature before cooling is completed in the current compartment, this may indicate that the speed of the current compartment mode (FF mode or FZ mode) should be increased the next time. The refrigerator does not significantly impact the quick pull-down after receiving new groceries or excessive door openings (higher speeds), as it maintains the same basic grid control.

In some embodiments, when the compressor speed increase is required (e.g., when the determined duty cycle is too high), the compressor speed with the highest positive-facing slope (the flattest line to the right of the point in the graph) may be raised. This adjustment aims to achieve the least possible increase in energy consumption. When a decrease in speed is needed, the controller reduces the speed with maximum negative-facing slope (the steepest to the left of each point). The location of each point is determined by the respective time-average evaporator temperatures, which are calculated either statically or dynamically during each cycle. If no overall speed change is necessary, both speeds may still be adjusted if the relative slopes suggest a more efficient operating point. The slope ratio is then multiplied by the duty cycle ratio for the FF/FZ compartments to directly minimize average power draw of the compressor.

Additional aspects of the present disclosure relate to an adaptive control scheme which adapts in response to changes in compressor efficiency over time. For example, aspects of the present disclosure may include determining compressor capacity as a function of time, e.g., time of day, such as based on averaged and/or aggregated data over a period of, for example, seven days, such as a rolling week.

Such averaged and/or aggregated data may be more responsive to actual operating conditions of the refrigerator appliance and thereby provide more accurate optimization, e.g., an optimal duty cycle determined based on data such as one or more temperature measurements taken at an evaporator while operating the compressor of the sealed system in the refrigerator appliance. For example, the optimal duty cycle may be determined with reference to an EER curve, and the EER curve may be selected based on the measured temperature(s).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a refrigerator appliance, the refrigerator appliance comprising a compressor within a sealed cooling system, the method comprising:

operating the compressor for a first portion of a period of time, wherein the first portion of the period of time includes a fresh food cooling time and a freezer cooling time;

measuring a fresh food cooling temperature at a fresh food evaporator of the sealed system while operating the compressor for the fresh food cooling time during the first portion of the period of time;

measuring a freezer cooling temperature at a freezer evaporator of the sealed system while operating the compressor for the freezer cooling time during the first portion of the period of time;

deactivating the compressor for a second portion of the period of time;

determining an actual duty cycle of the compressor based on a ratio of the first portion of the period of time to the period of time;

comparing a first energy efficiency ratio corresponding to the measured fresh food cooling temperature with a second energy efficiency ratio corresponding to the measured freezer cooling temperature;

determining an optimal duty cycle of the compressor based on the comparison of the first energy efficiency ratio with the second energy efficiency ratio;

comparing the actual duty cycle of the compressor to the optimal duty cycle; and adjusting a speed of the compressor based on the comparison of the actual duty cycle to the optimal duty cycle.

2. The method of claim 1, further comprising measuring power consumption during operation of the compressor and determining the efficiency of the compressor based on the measured power consumption.

3. The method of claim 1, wherein the compressor is operated at a fresh food cooling speed during the fresh food cooling time and is operated at a freezer cooling speed during the freezer cooling time, and wherein the adjusted speed of the compressor is one of the fresh food cooling speed and the freezer cooling speed.

4. The method of claim 1, wherein adjusting the speed of the compressor comprises adjusting the speed of the compressor at the end of one of the fresh food cooling time and the freezer cooling time.

5. The method of claim 1, wherein the optimal duty cycle is at least ninety-five percent.

6. The method of claim 1, wherein the compressor is operated at a fresh food cooling speed during the fresh food cooling time and is operated at a freezer cooling speed during the freezer cooling time, and wherein adjusting the speed of the compressor comprises adjusting both the fresh food cooling speed and the freezer cooling speed, whereby a total energy efficiency of the compressor across both the fresh food cooling time and the freezer cooling time is maximized.

7. The method of claim 6, wherein adjusting both the fresh food cooling speed and the freezer cooling speed comprises increasing one of the fresh food cooling speed and the freezer cooling speed and decreasing the other of the fresh food cooling speed and the freezer cooling speed.

8. The method of claim 1, wherein comparing the first energy efficiency ratio with the second energy efficiency ratio comprises comparing a slope of a first energy efficiency ratio curve with a slope of a second energy efficiency ratio curve.

9. A refrigerator appliance, comprising:

a compressor within a sealed cooling system; and a controller operatively coupled to the sealed cooling system, the controller configured to selectively control the refrigerator appliance according to an operation routine comprising:

operating the compressor for a first portion of a period of time, wherein the first portion of the period of time includes a fresh food cooling time and a freezer cooling time;

measuring a fresh food cooling temperature at a fresh food evaporator of the sealed system while operating the compressor for the fresh food cooling time during the first portion of the period of time;

measuring a freezer cooling temperature at a freezer evaporator of the sealed system while operating the compressor for the freezer cooling time during the first portion of the period of time;

deactivating the compressor for a second portion of the period of time;

determining an actual duty cycle of the compressor based on a ratio of the first portion of the period of time to the period of time;

comparing a first energy efficiency ratio corresponding to the measured fresh food cooling temperature with a second energy efficiency ratio corresponding to the measured freezer cooling temperature;

determining an optimal duty cycle of the compressor based on the comparison of the first energy efficiency ratio with the second energy efficiency ratio;

comparing the actual duty cycle of the compressor to the optimal duty cycle; and adjusting a speed of the compressor based on the comparison of the actual duty cycle to the optimal duty cycle.

10. The refrigerator appliance of claim 9, wherein the controller is further configured for measuring power consumption during operation of the compressor and determining the efficiency of the compressor based on the measured power consumption.

11. The refrigerator appliance of claim 9, wherein the compressor is operated at a fresh food cooling speed during the fresh food cooling time and is operated at a freezer cooling speed during the freezer cooling time, and wherein the adjusted speed of the compressor is one of the fresh food cooling speed and the freezer cooling speed.

12. The refrigerator appliance of claim 9, wherein adjusting the speed of the compressor comprises adjusting the speed of the compressor at the end of one of the fresh food cooling time and the freezer cooling time.

13. The refrigerator appliance of claim 9, wherein the optimal duty cycle is at least ninety-five percent.

14. The refrigerator appliance of claim 9, wherein the compressor is operated at a fresh food cooling speed during the fresh food cooling time and is operated at a freezer cooling speed during the freezer cooling time, and wherein adjusting the speed of the compressor comprises adjusting both the fresh food cooling speed and the freezer cooling speed, whereby a total energy efficiency of the compressor across both the fresh food cooling time and the freezer cooling time is maximized.

15. The refrigerator appliance of claim 14, wherein adjusting both the fresh food cooling speed and the freezer cooling speed comprises increasing one of the fresh food cooling speed and the freezer cooling speed and decreasing the other of the fresh food cooling speed and the freezer cooling speed.

16. The refrigerator appliance of claim 9, wherein comparing the first energy efficiency ratio with the second energy efficiency ratio comprises comparing a slope of a first energy efficiency ratio curve with a slope of a second energy efficiency ratio curve.

* * * * *